US007380843B2

(12) United States Patent
Alacqua et al.

(10) Patent No.: US 7,380,843 B2
(45) Date of Patent: Jun. 3, 2008

(54) LOCK DEVICE WITH SHAPE MEMORY ACTUATING MEANS

(75) Inventors: Stefano Alacqua, Rivoli Cascine Vica (IT); Francesco Butera, Turin (IT); Alessandro Zanella, Turin (IT); Gianluca Capretti, Orbassano (IT)

(73) Assignee: CRF Societa Consortile Per Azioni, Orbassano (Turin) (IT)

( * ) Notice: Subject to any disclaimer, the term of this patent is extended or adjusted under 35 U.S.C. 154(b) by 304 days.

(21) Appl. No.: 10/515,915

(22) PCT Filed: Mar. 12, 2004

(86) PCT No.: PCT/IB2004/000760

§ 371 (c)(1),
(2), (4) Date: Nov. 29, 2004

(87) PCT Pub. No.: WO2004/088068

PCT Pub. Date: Oct. 14, 2004

(65) Prior Publication Data

US 2005/0183479 A1 Aug. 25, 2005

(30) Foreign Application Priority Data

Apr. 4, 2003 (IT) ..... TO2003A0262

(51) Int. Cl.
*E05C 1/08* (2006.01)
*E05C 1/06* (2006.01)

(52) U.S. Cl. ..... 292/163; 292/137; 292/144; 292/146; 292/150; 292/DIG. 11; 70/277

(58) Field of Classification Search ..... 292/137, 292/163, DIG. 66, 126, 38, 144, 141, 171, 292/146, 150, DIG. 11; 70/277
See application file for complete search history.

(56) References Cited

U.S. PATENT DOCUMENTS

| | | | | |
|---|---|---|---|---|
| 2,497,485 | A * | 2/1950 | Yost et al. | 292/38 |
| 4,032,180 | A * | 6/1977 | Pohl | 292/341.16 |
| 4,718,705 | A * | 1/1988 | Case | 292/201 |
| 4,806,815 | A * | 2/1989 | Honma | 310/307 |
| 5,192,147 | A * | 3/1993 | McCloskey | 403/322.3 |
| 5,771,742 | A | 6/1998 | Petty et al. | |
| 6,008,992 | A * | 12/1999 | Kawakami | 361/726 |
| 6,310,411 | B1 | 10/2001 | Viallet | |
| 6,369,368 | B2 | 4/2002 | Graf et al. | |
| 6,871,519 | B2 * | 3/2005 | Butera et al. | 70/256 |

FOREIGN PATENT DOCUMENTS

| | | |
|---|---|---|
| EP | 1 279 784 A | 1/2003 |
| WO | WO 00/36622 A | 6/2000 |

* cited by examiner

*Primary Examiner*—Carlos Lugo
(74) *Attorney, Agent, or Firm*—Sughrue Mion, PLLC

(57) ABSTRACT

A lock device which includes a bolt actuated by a flexible shape memory element. The memory element can assume an extended or a shortened configuration as a result of heating. A constraining element which includes two points between which an intermediate portion of the shape memory extends is also provided. At least of the two points belongs to a moveable transmission element which moves when the shape memory element extends. As a result, a controlled element is moved from between an operating position and a non-operating position.

10 Claims, 5 Drawing Sheets

LOCK DEVICE WITH SHAPE MEMORY ACTUATING MEANS

BACKGROUND OF THE INVENTION

This is a National Stage of Application No. PCT/IB2004/000760 filed Mar. 12, 2004; the disclosure of which is incorporated herein by reference.

The present invention relates to a lock device comprising at least a first controlled element, in particular a bolt, which can be shifted with respect to a stationary structure between an operating and a non-operating position, actuating means which can be actuated in order to shift the first controlled element from its operating to its non-operating position, comprising a flexible shape memory element that can take an extended and a shortened configuration, constraint means for determining the arrangement of at least a first intermediate portion of the shape memory element, within which portion said element is operatively associated to the first controlled element, means for obtaining the heating up the shape memory element, so as to cause its passage from the extended configuration to the shortened configuration and thus shift the first controlled element from its operating to its non-operating position.

SUMMARY OF THE INVENTION

A lock as mentioned above is described in U.S. Pat. No. 6,310,411. In said solution the lock is equipped with a bolt moving between a blocked position and a released position, and with a coil-shaped wire made of a shape memory alloy, the two wire ends being connected to a first and a second electric supply terminal, respectively; the lock comprises at least a first and a second connection element for the wire, between which an intermediate portion of the latter is arranged in rectilinear direction, parallel to the direction of movement of the bolt. On said intermediate portion the shape memory wire is mechanically fastened to the bolt and is electrically connected to a third supply terminal.

Shape memory actuating elements have been known for a long time and used in various fields in which simple and cheap actuating means are required. They are made for instance of shape memory metal alloys that can deform above a given transition temperature. In general, heating can be achieved since the actuating element directly detects a variable temperature, or by supplying an electric current through the actuating element so as to heat it by Joule effect.

Going back to the lock described in U.S. Pat. No. 6,310,411, when an electric current is applied between the first and third terminal, the wire portion extending between them gets shorter, including a part of the aforesaid rectilinear portion, thus shifting the bolt towards the release position of the lock; such shift also results in the switching of a spring bistable mechanism; when the electric supply between the first and third terminal is interrupted, the shape memory wire taking again its extended structure, the bistable mechanism keeps the bolt in the position it has reached. On the other hand, by applying an electric voltage between the second and third terminal, the shape memory wire portion extending between said terminal shrinks, thus causing a bolt shift opposed to the previous one, i.e. towards the blocked position of the lock; here again, the bolt shift results in the switching of the bistable mechanism which, once the electric supply between the second and third terminal has been interrupted, keeps the bolt in the position it has reached, although the shape memory wire has taken again in the meanwhile its extended structure.

Basically, therefore, according to the solution described in U.S. Pat. No. 6,310,411, the shrinkage of the shape memory wire is used to generate a traction of the bolt developing alternatively towards the first or second connection element, between which the aforesaid rectilinear wire portion is defined. The bolt is thus pulled in one direction or the other and the bistable cinematic mechanism keeps the bolt in the position it has reached.

The presence of several terminals for supplying the shape memory wire with current, as well as the coil-shaped arrangement of said wire, with a rectilinear intermediate portion, makes lock production more complex and increases the size of said lock; the same can apply to the presence of the bistable system required for keeping the position reached by the bolt without electric supply. Moreover, the shape memory wire should have a considerable length, which affects lock manufacturing costs. The electric control system of the lock is further complicated in that the shape memory wire is operatively divided into two portions which should be supplied selectively with current.

The present invention aims at carrying out a lock as referred to above, which is simpler and cheaper with respect to the prior art mentioned above. Another aim of the invention is to indicate such a lock with an extremely small size. An additional aim of the invention is to indicate such a lock in which the return of the bolt from its non-operating to its operating position takes place rapidly, after the electric supply to wire made of shape memory material has ceased.

One or more of said aims are achieved according to the present invention by a lock device as referred to above, characterized in that the aforesaid constraint means are in such relative positions that the aforesaid first intermediate portion of the shape memory element takes a substantially V-shaped arrangement at least when the first controlled element is in its operating position.

Thus, when the shape memory element gets shorter after heating, the aforesaid intermediate portion tends to take a rectilinear or less prominent V-like arrangement; the shape memory element thus generates a transversal or basically perpendicular traction with respect to an ideal straight line joining two connection points between which extends the intermediate portion.

The aforesaid traction can thus be obtained by supplying the shape memory element, which is preferably wire-shaped, on its two ends with current, without the need for intermediate electric terminals; the wire can thus have a small length and a reduced size. Preferably, the return of the controlled element to its non-operating position is achieved through elastic means, when the electric supply of the shape memory element is interrupted. In a preferred embodiment of the invention, the same shape memory element is arranged so as to control also the shift of a second controlled element towards its non-operating position, with movement in opposite direction with respect to the first controlled element.

Further preferred characteristics of the invention are indicated in the appended claims, which are an integral and substantial part of the present invention.

BRIEF DESCRIPTION OF THE DRAWINGS

The invention shall be described with reference to the accompanying drawings, provided as a mere nonlimiting example, in which.

DETAILED DESCRIPTION OF THE DRAWINGS

Figure 1:
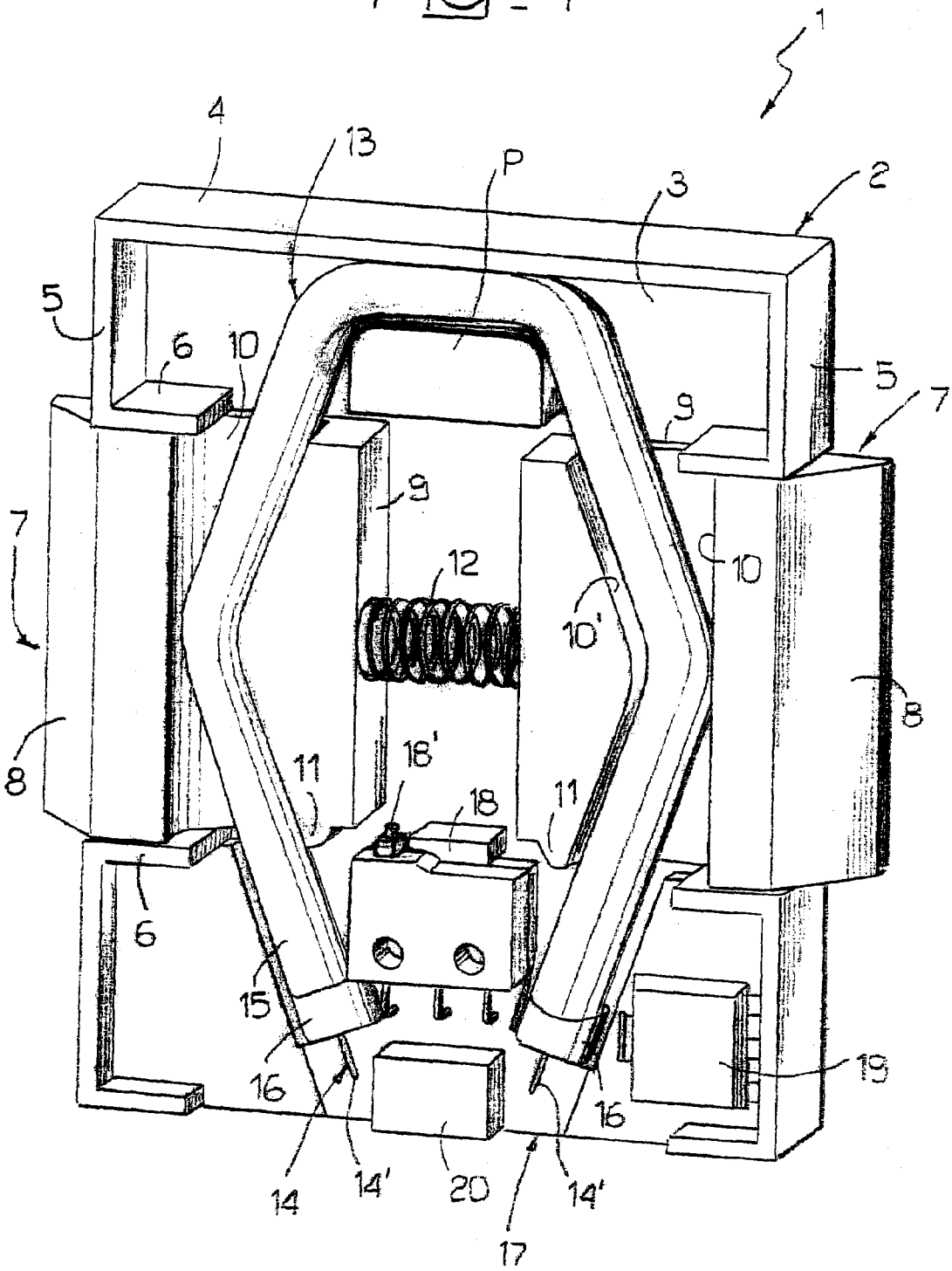
FIG. 1 is a perspective view of a lock according to the invention.

In FIG. 1 number 1 globally refers to a lock made in accordance with the teachings of the present invention. Said lock 1 comprises a box-shaped body 2, made for instance of molded thermoplastic material, having a rear wall 3, an upper wall 4, two side walls 5 and a lower wall with a central opening; a closing lid, not shown in FIG. 1, can be fastened onto the body 2. In the case shown by way of example, each side wall 5, has in an intermediate portion, a passage delimited by parallel guides 6 for a respective sliding bolt 7. Each bolt 7 has a head portion 8, basically tooth-shaped or however delimited by at least an inclined plane, and an inner portion 9, within which a groove 10 is defined, delimited on one side by a surface 10' whose length has a basically V-like development. At least the left bolt 7 (with reference to the figures) has on its lower edge a protuberance or a step 11, whose functions shall be disclosed below.

Between the two opposite bolts 7 an elastic element is mounted, here represented by a coil spring 12, whose elastic reaction pushes the bolts 7 in opposite directions, towards the outside of the body 2, through the passages defined between the respective pairs of guides 6. Each end of the spring 12 is inserted into a hollow seating having a circular section, extending towards the inside of the portion 9, starting from the edge of the latter opposite the head portion 8.

Number 13 globally indicates a shape memory actuating element. Said actuating element 13 is shaped like a flexible cable, comprising a core consisting of a wire 14 made at least partially with a shape memory material. Onto the wire 14 a layer of elastic coating 15 is molded, which adheres to said wire and is chosen in an elastomer/silicone or synthetic material; as shall be evident from the following, the coating 15 helps both the wire 14 to cool down after current has ceased to pass through the latter, and the wire 14 to go back to a rest condition, as a consequence of the elastic recovery of the coating 15. The coating 15 is preferably molded onto the wire 14 by simultaneously extruding the material which the wire 14 is made of and the material which the coating 15 is made of. In other words, during the manufacturing process, the wire 14 and its coating 15 are obtained simultaneously by a co-extrusion process, which is advantageous in that it enables to obtain the desired structure with one operation, without any additional assembling operation. The coating 15 adhering to the wire 14 acts like a longitudinally ditributed spring, which undergoes compression when the wire 14 gets shorter after activation and, therefore, helps said wire to go back to its rest position thanks to its elastic recovery.

The cable actuator 13 basically has the configuration of an upside-down U, so that the two ends of the wire 14, referred to with 14' in FIG. 1, are close to one another. In the embodiment shown by way of example, the cable actuator 13 comprises an upper section and two opposite side sections; each side section is partially inserted into a groove 10 of a respective bolt 7, so that the two side sections take a V-like arrangement, following the side surface 10' of the respective groove 10.

From the rear wall 3 of the body 2 at least a stationary transmission element P for the cable actuator 13 protrudes, which operates basically between the upper rectilinear section of said actuator and its two V-like side sections; the two ends of the coating 15 are inserted each into a corresponding bushing 16, from which the ends 14' of the wire made of shape memory material protrude, said ends being electrically and mechanically connected to a printed circuit board 17. The cable actuator 13 thus has a global development like a hexagon opened on its base. Onto the board 17, to which the two ends 14' of the wire 14 are electrically and mechanically connected, a micro-switch 18 is mounted, said switch being of NC type (normally closed), from whose shell a sensing head 18' protrudes upwards; the micro-switch 18 is substantially placed between the two bolts 7, slightly below the latter, so that the step 11 of the bolt 7 shown on the left in FIG. 1 can push the sensing head 18' when said bolt gets into the body 2, as shall be evident in the following. Still onto the board 17 the following are mounted: a component 19 controlling the electric supply of the wire 14, such as a MOSFET (being represented in FIG. 1 only), and a conventional connector 20 connecting the electric circuit to a suitable supply source, not shown. The board 17 and the components thereto associated (micro-switch 18, MOSFET 19 and connector 20) make up globally the supply means for applying an electric voltage to both ends 14' of the wire 14, so as to heat the latter by Joule effect and, therefore, shorten it.

The operation of the lock 1 shall now be described assuming that said lock is mounted onto a glove compartment door within the instrument panel of a motor vehicle.

Figure 2:
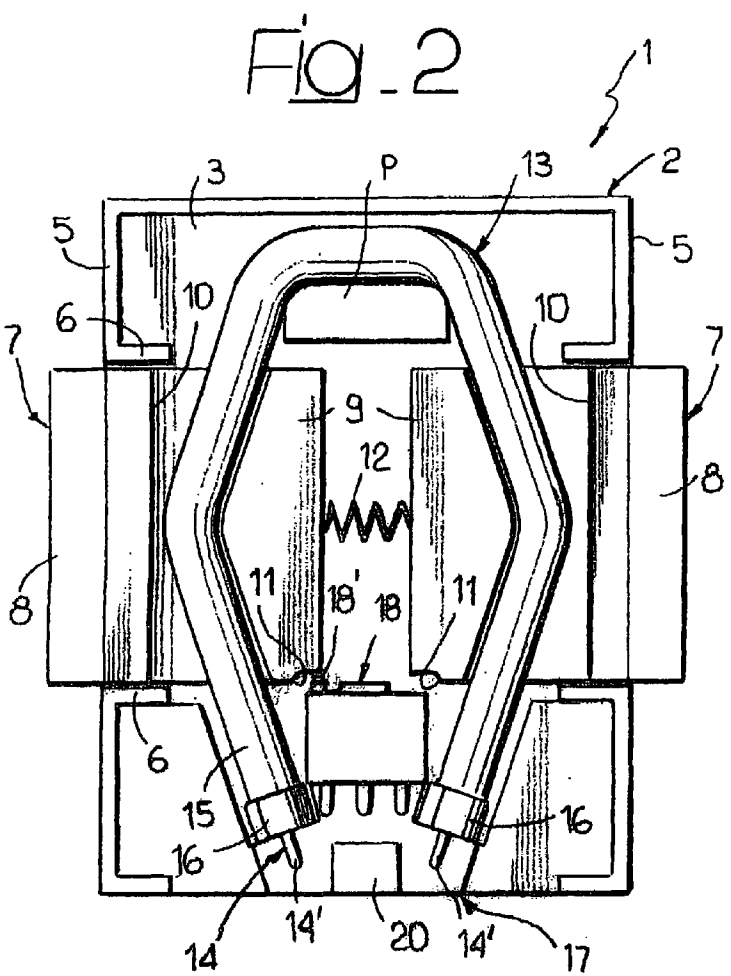

In FIG. 2 the lock 1 is shown in its operating condition, resembling the one of FIG. 1. The spring 12 constantly pushes in opposite directions the bolts 7, so that their portions 8 protrude outside the body 2 and engage into corresponding seatings defined on the instrument panel body, not shown. Under these circumstances, the cable actuator 13 is not supplied electrically and thus the wire 14 is in its extended condition; as can be seen, under these circumstances, the sensing head 18' freely protrudes from the shell of the micro-switch 18.

When the door equipped with the lock 1 has to be opened, and thus said lock has to be led to its non-operating position, the connector 20 is supplied with electric current by means of suitable conductors, not shown; supply can be actuated for instance by acting upon a pushbutton. Thus, the MOSFET 19 checks that a suitable electric voltage is applied to the ends 14' of the wire 14, which is thus progressively heated by Joule effect; above a given transition temperature the wire starts getting shorter; the shrinkage of the wire 14 also results in the compression of the coating 15, so that the whole cable actuator 13 tends to take a shortened configuration.

Figure 3:
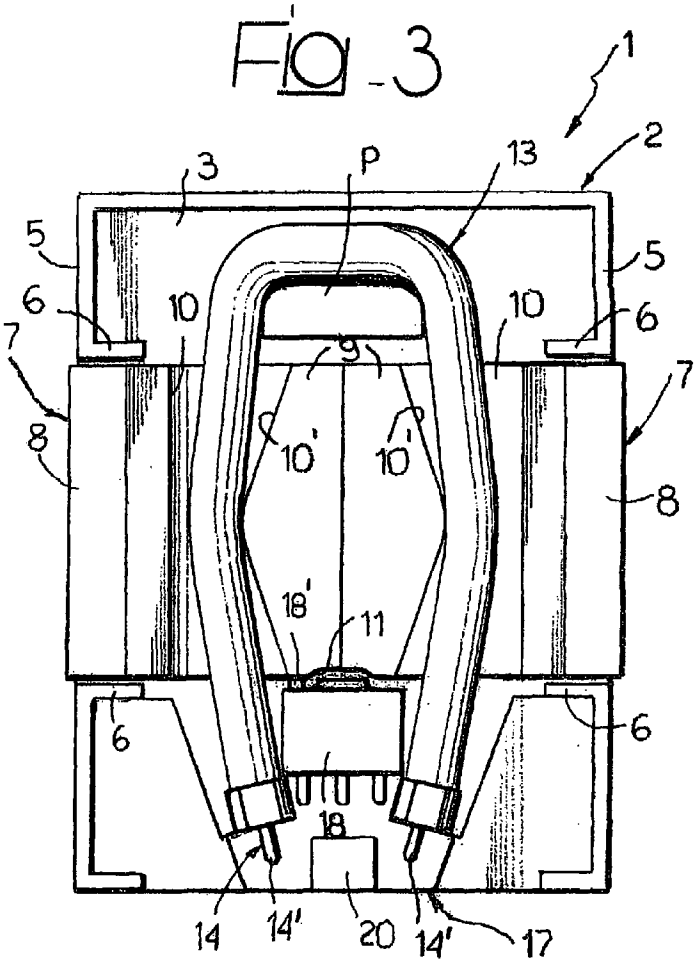
FIGS. 2 and 3 are front views of the lock of FIG. 1, in a first and second operating condition, respectively.

As a consequence of said shrinkage, the two opposite V-shaped sections of the wire 14 tend to take a rectilinear development, without however necessarily achieving the latter (see FIG. 3). Given the engagement of the V-shaped sections of the actuator 13 into their respective grooves 10, the shrinkage of the actuating element 13 thus results in a traction on the surfaces 10', such as to overcome the elastic reaction of the spring 12 and to cause a corresponding sliding of the bolts 7 one towards the other; as can be inferred, said traction is exerted in transversal or basically perpendicular direction with respect to an ideal straight line joining two connection points between which extends each V-shaped section, i.e. the anchoring point of the corresponding end 14' of the wire and the corresponding return portion P. The fact that the two bolts 7 get closer to one another results in the compression of the spring 12, which is thus inserted almost completely into its end housings defined on the opposite edges of said bolts. Thus the operating condition as in FIG. 3 is achieved, in which the bolts 7 are almost completely back into the body 2; the respective head portions 8 thus get released from the aforesaid seatings within the instrument panel body, and the door to which the lock 1 is associated can be opened. At a certain moment during the stroke of the bolts 7, the step 11 of the left bolt causes the compression of the sensing head 18' of the micro-switch 18, and thus the opening of the latter. Said opening actuates the opening of the electric circuit, or anyway the interruption of the supply to the wire 14, which then starts to cool down and thus to extend; while the wire 14 and the cable actuator 13 as a whole tend to reach their extended configuration, the elastic reaction of the spring 12 results in the linear sliding of the bolts 7 towards the outside of the body 2, in opposite directions, until they go back to the condition as in FIG. 2.

As previously mentioned, the coating 15 adhering to the wire 14 acts like a longitudinally distributed spring. Indeed, the elastomer/silicone material of the coating 15 on the wire 14 is chosen so as to obtain a double advantage. On one hand, said material, which is no electric conductor, does not heat up, as conversely happens for the wire 14 when an electric current gets through it during the activation of the cable actuator 13; as a consequence, the material which the coating 15 is made of helps and accelerates the cooling of the wire 14 at the end of the electric supply stage. On the other hand, the coating 15, being made of elastic material, acts like a distributed spring which is compressed when the wire 14 gets shorter as a result of its activation; as a consequence, the coating 15 helps a swift return of the cable actuator 13 to its rest condition, at the end of an electric supply stage, not only since it accelerates cooling but also because it pushes the cable actuator 13 towards its rest condition thanks to its elastic recovery, when the electric supply to the wire 14 ceases.

The door equipped with the lock 1 can then be led manually to its closing position. In this way, the inclined planes of the head portions 8 of the bolts 7 get in contact with the edge of the aforesaid seatings of the instrument panel body; a light closing pressure on the door, such as to overcome the strength of the spring 12, then makes the bolts 7 get back into the body 2; when the ends of the portions 8 get beyond the edge of said seatings, the recovery of the spring 12 makes the bolts 7 get back and engage into said seatings. It should be pointed out that the aforesaid mechanical return of the bolts 7 is enabled also thanks to the shape of the grooves 10, which have an enlargement on the opposite side with respect to their surfaces 10', and thanks to the presence of the transmission element P; this allows the cable actuator 13, which is in any case flexible, to change its shape temporarily, even when it is in its extended condition, and then take it again at the end of the mechanical stress.

From the above it is possible to infer how the control carried out onto the cable actuator 13 is continuous and how each bolt 7, after the electric supply to the wire 14 has ceased, can automatically go back to its operating position, however enabling to close manually the door to which the lock 1 is associated.

In the case described above, the lock 1 is led to its non-operating or opened position by electric supply. In a possible execution variant, however, the lock 1 can be equipped with means enabling also a manual opening. Such a case is shown by way of example in FIGS. 4 and 5, where a body 2, basically resembling the one as in the previous figures, is associated to a lid 25, defining two front passages 26 through which two parallel extensions 27 protrude, each extension 27 protruding upwards from a respective bolt 7.

Figure 5:
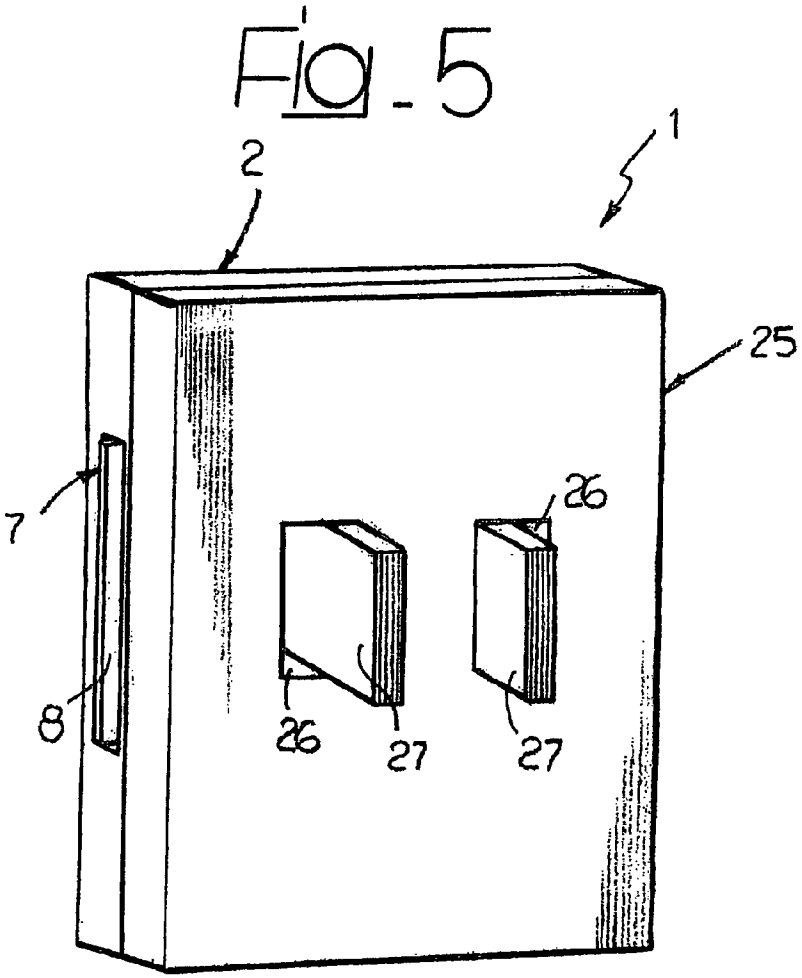
FIGS. 4 and 5 are front views of a lock made in accordance with a possible variant of the invention, in operating conditions resembling those of FIGS. 2 and 3, respectively.
Figure 4:
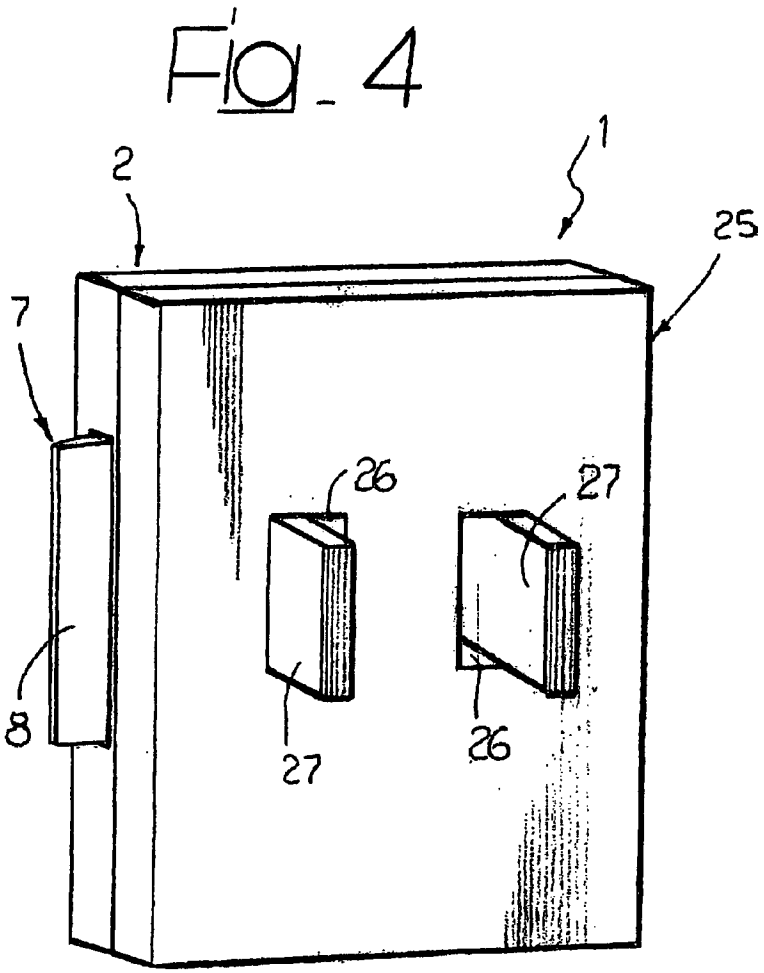

FIG. 4 shows an operating condition resembling the one as in FIG. 2, in which the head portions 8 of the bolts 7 protrude from the body 2; by acting manually upon the extensions 27, i.e. by placing them closer to one another, the bolts 7 can be shifted towards the inside of the body 2, so as to take the non-operating position of the lock 1 as in FIG. 5. The position of FIG. 5 can thus be reached without supplying the shape memory wire 14 with electric current, only by acting manually upon the extensions 27 so as to place them closer to one another, thus overcoming the reaction of the spring 12; such position can be reached also thanks to the width of the grooves 10, as explained above.

In the case of FIGS. 4 and 5, the extensions 27 can be manually actuated in a direct manner, since they are visible. As an alternative, said extensions 27 can be part of a controlled actuating cinematic mechanism, for instance a single handle or a key block as known per se. An example of said cinematic mechanism is shown schematically in FIGS. 6 and 7. In said figures, number 30 refers to an actuating element, which can be shifted angularly around a corresponding hinging pin 31; as previously mentioned, the element 30 can be part of a rotating handle, to be actuated manually by a user, or it can be associated to a key mechanism, as known per se. Number 32 refers to two basically L-shaped levers, opposed to one another and between which the actuating element 30 is mounted; said levers 32 can be shifted angularly around respective hinging points 33; number 34 then refers to the end portions of extensions resembling extensions 27 as in FIGS. 4 and 5, i.e. each integral with a corresponding bolt 7.

Figures 6, 7:
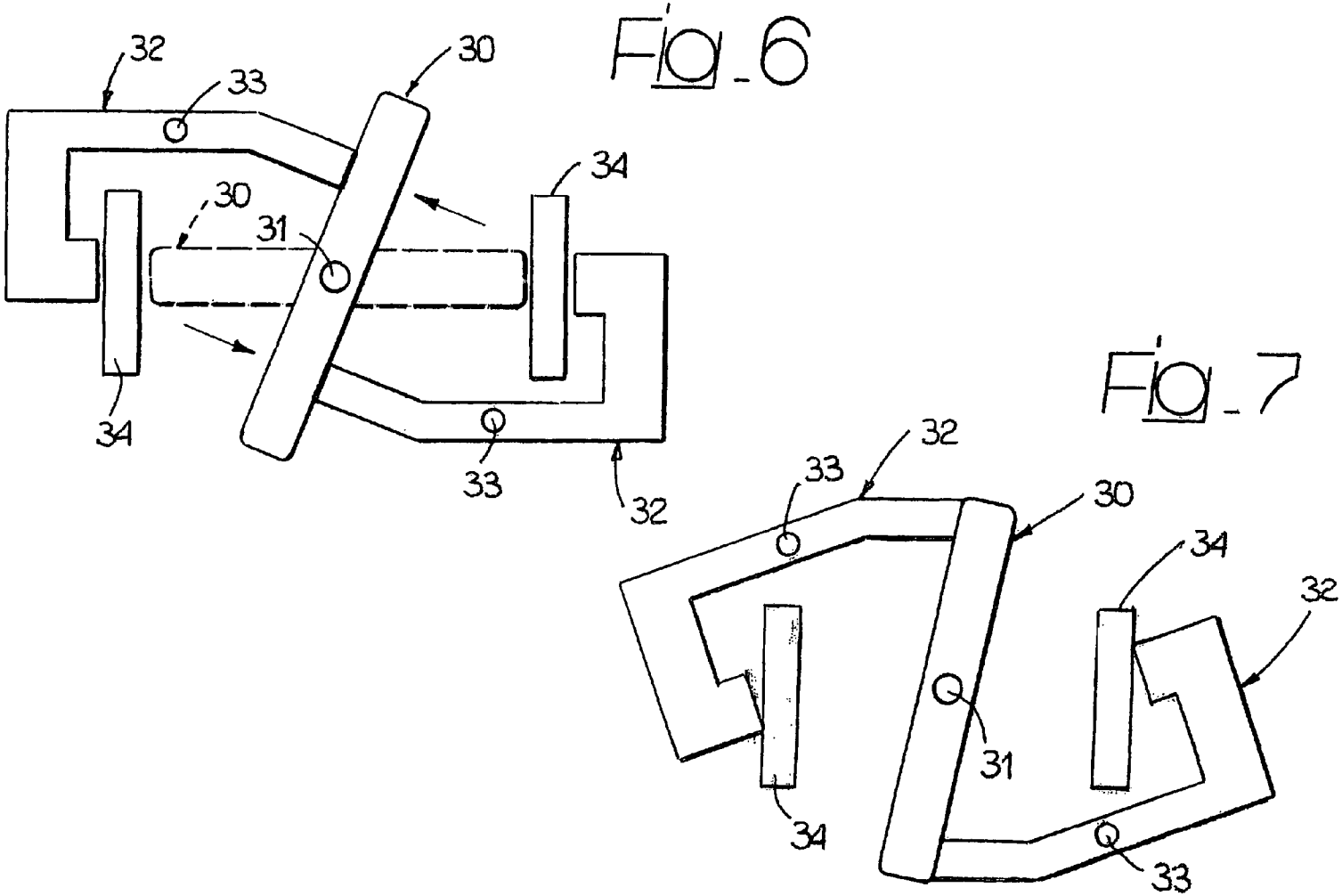
FIGS. 6 and 7 are schematic views of a cinematic mechanism which a lock made in accordance with a further possible variant of the invention is equipped with, in different operating conditions.

The actuating element 30 can take a non-operating position, as shown by the hatched line of FIG. 6, in which it is in a basically perpendicular position with respect to the extensions 34, and not in contact with the levers 32. The element 30 can be rotated counter-clockwise, starting from its non-operating position, so that its end portions get each in contact with first ends of the levers 32, as shown by the full line of FIG. 6. The further angular movement of the element 30 then results in the progressive angular shift of each lever 32, so that its second end gets in contact with a corresponding extension 34, causing its shift towards the hinging pin 31 of the element 30; said second ends of the levers 32 slide on the surface of the extensions 34 as far as the position of FIG. 7, in which said extensions are closer to one another, i.e. in a position resembling the one of FIG. 5. By leading the actuating element 30 back to the position shown by a hatched line in FIG. 6, the levers 32 are then free to go back to their starting positions, as a result of the thrust of the extensions 34 in a direction opposed to the previous one, thanks to the elastic action of the spring 12 operating between the bolts 7 with which said extensions are integral.

Figure 8:
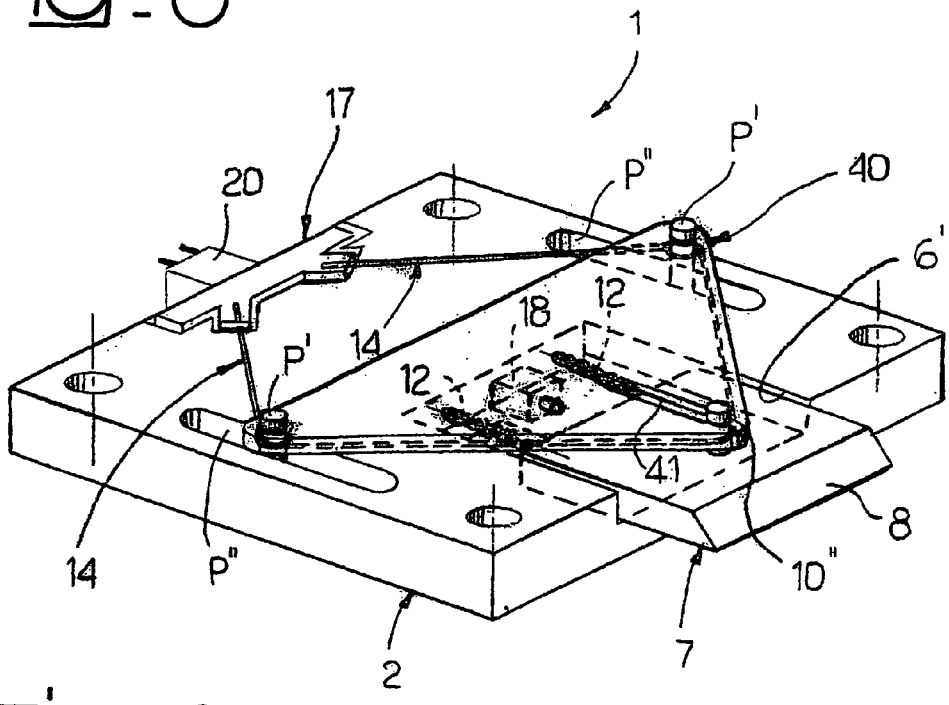
FIG. 8 is a schematic perspective view of a lock made in accordance with a further possible variant of the invention.
Figure 9:
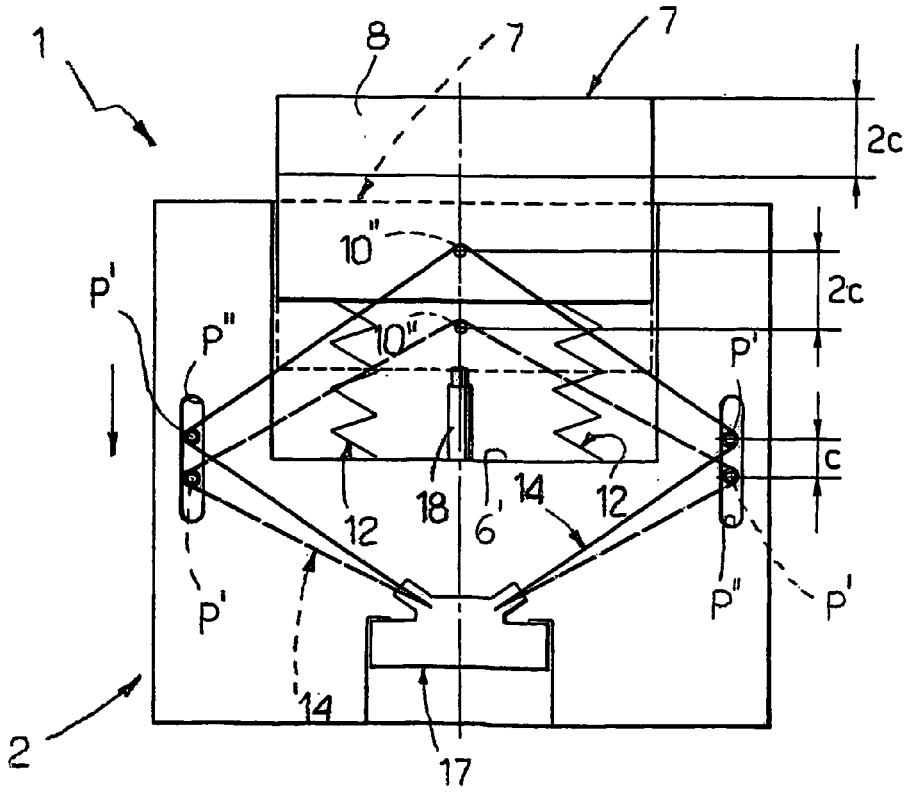
FIG. 9 is a schematic plan view designed to explain the operating principle of the lock in FIG. 8.

FIGS. 8 and 9 show a further execution variant of the invention; in said figures the same numbers as in the previous figures are used for indicating technically equivalent elements as the ones previously referred to.

In accordance with said variant, the lock 1 comprises a body 2 defining an embedded seating 6' for one bolt 7; at the bottom of said seating 6' a micro-switch 18 is located; between the bottom of the seating 6' and the end portion of the bolt 7 operate two coil springs 12 basically parallel to one another.

The body 2 is associated in a stationary way to a board 17, to which the micro-switch 18 is electrically connected and which has its supply connector, referred to with 20 in FIG. 8; as in the embodiment of FIG. 1, the board 17 is mechanically and electrically connected to the ends of the shape memory wire 14, which can be provided with its coating 15, if necessary, so as to obtain the cable actuating element previously referred to with 13. P' refers to the peg-shaped portions of two transmission elements for the wire 14; in the present variant, the aforesaid transmissions P' can shift and in particular slide linearly within corresponding guides P", defined in parallel directions within opposite portions of the body 2; in the case shown by way of example, the guides P" extend longitudinally in the same direction as the movement of the bolt 7, as shall be evident from the following. Number 10" refers to a peg protruding from the bolt 7 and constituting a connection point for the wire 14 onto the bolt 7. It should be pointed out that the wire 14 can be arranged as a coil on a corresponding peg P', as can be seen in FIG. 8, or simply rest onto the pegs P', as in FIG. 9.

Number 40 refers to a connection plate, having substantially a triangular shape and with respective passages into which the pegs P' are inserted; the plate 40, shown only in FIG. 8, also has a slot or passage 41 into which the pegg 10" associated to the bolt 7 is inserted; the slot 41 extends longitudinally in the same direction as the movement of the bolt 7. The plate is placed above the wire 14.

The lock as in FIGS. 8 and 9 works as follows.

The springs 12 constantly push the bolt 7, so that its portion 8 protrudes outside the body 2. Under these circumstances, the wire 14 is not supplied with electric current and therefore has an extended configuration; under these circumstances, the transmission pegs P' are in a first position within their guides P"; said condition is shown with a full line in FIG. 9.

When said lock 1 has to be led to its non-operating position, the connector 20 is supplied with electric current. Thus an electric voltage is applied to the ends of the shape memory wire 14, which then progressively heats up by Joule effect; above its transition temperature, said wire 14 starts getting shorter and thus takes a shortened configuration.

The shrinkage of the portions of the wire 14 extending between the board 17 and a corresponding peg P' results in a traction on the latter, such as to overcome the elastic reaction of the springs 12; the pegs P', connected to one another through the plate 40, shift towards the board 17 on the stroke referred to with "c" in FIG. 9. The plate 40 transfers the movement of the pegs P' to the peg 10" of the bolt 7, which is thus given a "c" stroke towards the inside of the seating 6'.

At the same time, the shrinkage of the portions of the wire 14 extending between the pegs P' and the peg 10" results in a further traction on the bolt 7, and thus in a shift of the latter added to the previous "c" stroke; the total stroke of the bolt 7 is thus basically of "2C", as schematically shown in FIG. 9; as can be inferred, here again the traction on the bolt 7 is exerted in a transversal or basically perpendicular direction with respect to an ideal straight line joining two connection points between which extends the concerned V-shaped section of the wire 14, i.e. the pegs P'.

Thus, the operating condition shown with a hatched line in FIG. 9 is achieved, in which the bolt 7 is almost completely got back into the seating 6' and within the body 2; at a certain moment during the stroke of the bolts 7, the latter opens the micro-switch 18, thus interrupting the electric supply to the wire 14, which then starts to cool down and thus to extend; while the wire 14 tends to reach its extended structure, the elastic reaction of the springs 12 results in the linear sliding of the bolt 7 towards the outside of the body 2, until it goes back to the condition shown with a full line in FIG. 9. If necessary, the presence of the slot 41 then allows to lead the bolt 7 back into its corresponding seating 6', if the door with the lock 1 has to be closed manually, as previously described with reference to the embodiment as in FIGS. 1-3.

Practical tests have shown that the lock according to the invention enables to obtain the intended aims. Indeed, said lock is simple and cheap and has an easy control, both in case of electric and manual actuation. The particular arrangement enables to minimize the size of the lock 1; by the way, the outer size of the body 2 can be of 4×4 0.5 cm.

Obviously, though the basic idea of the invention remains the same, construction details and embodiments can widely vary with respect to what has been described and shown by mere way of example, however without leaving the framework of the present invention.

In accordance with a first variant, the lock could be equipped with one bolt 7, with one or more springs 12 mounted between said bolt and a stationary surface of the body 2, which would have in this case a smaller size than the case shown in the figures. In case of one bolt, the cable actuating element could have a development resembling the one shown in the previous figures, with suitable guides, or be V-shaped, i.e. be shaped like one of the side sections of the actuator previously referred to with 13; in the latter case, a first end of the wire 14 can be connected directly and mechanically to the board 17, as in the accompanying figures, whereas the second end can be mechanically fastened to the body 2 on the side longitudinally opposed to the one in which the board is present; through an electric conductor said second end can then be electrically connected to the board 17.

A second variant, applying in particular to the case in which the lock 1 is equipped with one bolt 7, consists in making the cable actuator 13 with a U-like shape memory wire, having a going and return portion immersed in a common coating made of elastomer/silicone material, as referred to above; thus, the two ends of the wire, close to one another, protrude from a longitudinal end of the common coating, for the electrical and mechanical connection to the same base of the supply circuit; conversely, the arc-shaped portion of the shape memory wire protruding from the other longitudinal end of the coating builds a sort of ring, which is fitted onto a peg protruding from the bottom wall 3 of the body 2; said peg thus builds a mechanical connection for an end of the cable actuator, the opposite end of the latter being mechanically and electrically connected to the base. Such an arrangement, in which the actuator has a general V-shape, is advantageous because both ends of the shape memory wire are close to one another and can thus be connected directly to the same board, without the need for the electric conductor as in the previous variant.

The invention also applies to the case in which the bolt or bolts are shaped like rocking arm hooks instead of moving linearly.

In some applications of the lock device according to the invention, the shape memory element 14 could directly detect the temperature to which it is subject, for instance the temperature of a gas or a liquid, so as to be actuated by said temperature at a transition value that can be adjusted when preparing the shape memory material used; in said light, for instance, the device 1 could be designed to keep a partition closed, against the action of elastic means, and be directly subject to a fluid to be controlled. When said fluid shifts from a first to a second given temperature, the wire 14, here without the coating 15, shifts from its extended to its shortened structure, so as to switch automatically the lock to its opened position.

The invention claimed is:

1. A lock device comprising:

a controlled element which is displaceable with respect to a stationary structure between an operating and a non-operating position, the controlled element being displaceable in a first direction;

actuating means, which can be actuated to displace the controlled element from the operating position to the non-operating position, the actuating means comprising a flexible shape memory element that can take an extended and a shortened configuration, the shape memory element having a first end and a second end anchored with respect to the stationary structure;

constraint means for determining the arrangement of an intermediate portion of the shape memory element, within which portion the shape memory element is associated to the controlled element both in the operating position and the non-operating position thereof; and means for heating up the shape memory element, so as to cause passage thereof from the extended configuration to the shortened configuration and thus displace the controlled element from the operating position to the non-operating position;

wherein the constraint means are in such relative positions that said intermediate portion of the shape memory element takes a substantially V-shaped form at least when the controlled element is in the operating position thereof, the constraint means comprising at least two points between which the intermediate portion extends, such that, during passage of the shape memory element from the extended configuration to the shortened configuration, the intermediate portion tends to take a rectilinear form, wherein one of said two points belongs to a movable transmission element that makes a shift with respect to the stationary structure in said first direction, during passage of the shape memory element from the extended configuration to the shortened configuration; and wherein a second portion of the shape memory element extends between said transmission element and said first end such that, during passage from the extended configuration to the shortened configuration, the shape memory element generates a traction on said transmission element to cause the shift thereof in said first direction, wherein the constraint means comprise a further movable transmission element, that makes a shift with respect to the stationary structure in said first direction, during passage of the shape memory element from the extended configuration to the shortened con-figuration;

wherein the other one of said two points belongs to said further movable transmission element; and wherein the shape memory element has a third portion, extending between said further transmission element and said second end, such that, during passage from the extended con-figuration to the shortened configuration, the shape memory element also generates a traction on said further transmission element causing the shift thereof in said first direction, and wherein the lock device further comprises a connection element for mechanically connecting said transmission elements to the controlled element, the connection element being plate-shaped.

2. The device according to claim 1, wherein the controlled element is mounted on the stationary structure for linearly sliding between the operating position and the non-operating position.

3. The device according to claim 1, wherein elastic means are provided for constantly biasing the controlled element towards the operating position thereof.

4. The device according to claim 1, wherein the constraint means comprise means for guiding the shape memory element, being associated to the controlled element.

5. The device according to claim 1, wherein the means for heating up the shape memory element comprise means for electric supply, including at least a switch having a switching element that is actuated by the controlled element when the first controlled element is displaced from the operating position to the non-operating position.

6. The device according to claim 1, wherein the shape memory element is provided with a coating made of synthetic material, said coating being elastically deformed when the shape memory element passes from the extended configuration to the shortened configuration.

7. The device according to claim 6, wherein the shape memory element is U-shaped within the coating, so as to have a going and a return portion that are parallel and close to one another, and with said first and second ends close to each another.

8. The device according to claim 1, further comprising manual actuating means, for manually displacing the controlled element from the operating position to the non-operating position.

9. The device according to claim 1, wherein said transmission element is mounted for sliding linearly in a guide that is defined in the stationary structure.

10. The device according to claim 1, wherein each of said transmission elements is mounted for sliding linearly within a respective guide that is defined in the stationary structure, the guide of the first transmission element and the guide of the further transmission element extending parallel to each other.

* * * * *